United States Patent [19]

Wilson

[11] Patent Number: 4,503,778

[45] Date of Patent: Mar. 12, 1985

[54] TRANSPORTATION SYSTEM

[76] Inventor: Fillmore G. Wilson, 10807 Candlewood, Houston, Tex. 77042

[21] Appl. No.: 341,961

[22] Filed: Jan. 22, 1982

[51] Int. Cl.[3] ..... B61B 1/02; B61B 3/00

[52] U.S. Cl. ..... 104/28; 49/262; 104/89; 104/119; 104/124; 104/168; 104/248; 105/144; 105/148; 105/329 R; 105/341; 180/281; 238/134

[58] Field of Search ..... 104/28, 30, 89, 91, 104/106, 118, 119, 124, 165, 168, 241, 248; 105/141, 144, 146, 148, 329 R, 329 S, 341; 180/281; 49/262; 238/134, 135

[56] References Cited

U.S. PATENT DOCUMENTS

| | | | |
|---|---|---|---|
| 276,878 | 5/1883 | Pyott | 104/124 |
| 1,431,536 | 10/1922 | Maloney | 104/119 |
| 3,039,402 | 6/1962 | Richardson | 104/168 |
| 3,403,633 | 10/1968 | Schwarzkopf | 104/168 X |
| 3,403,634 | 10/1968 | Crowder | 104/28 X |
| 3,467,026 | 9/1969 | Broggie et al. | 105/341 |
| 3,590,743 | 3/1969 | Larson | 104/89 X |
| 3,881,427 | 5/1975 | Blume | 105/141 |
| 3,971,324 | 7/1976 | Frech | 104/28 |
| 4,000,702 | 1/1977 | Mackintosh | 104/89 X |

FOREIGN PATENT DOCUMENTS

| | | | |
|---|---|---|---|
| 81005 | 4/1893 | Fed. Rep. of Germany | 104/119 |
| 3018009 | 11/1981 | Fed. Rep. of Germany | 104/89 |
| 2431944 | 3/1980 | France | 104/89 |
| 626692 | 10/1961 | Italy | 104/118 |
| 439617 | 5/1975 | U.S.S.R. | 104/165 |

*Primary Examiner*—Randolph Reese
*Attorney, Agent, or Firm*—Dority & Manning

[57] ABSTRACT

A transportation system for rapidly loading people from a platform into and from a plurality of cars. The system includes an elongated trackway which extends along a platform. Trolleys extend between the trackway and the cars supporting the cars on the trackway. The cars have side doors extending along the length thereof which open towards the platform to provide access to a single row of seats carried in the vehicles facing the doors. The doors can be automatically opened and closed upon reaching the platform. The trackway includes upper lower and intermediate rails upon which upper, lower and intermediate wheels, carried by the trolleys, engage to provide an interlocking relation therebetween. A vertically extending keel is carried by at least some of the vehicles for engaging power driven wheels that are positioned along the trackway. An adjustable pressure bearing wheel is carried on the opposed side of the keel from the power-driven wheels for maintaining the keel in driving contact with the power-driven wheels. The power-driven wheels are connected to a D.C. motor/generator for selectively propelling the cars along the trackway and braking the cars.

15 Claims, 11 Drawing Figures

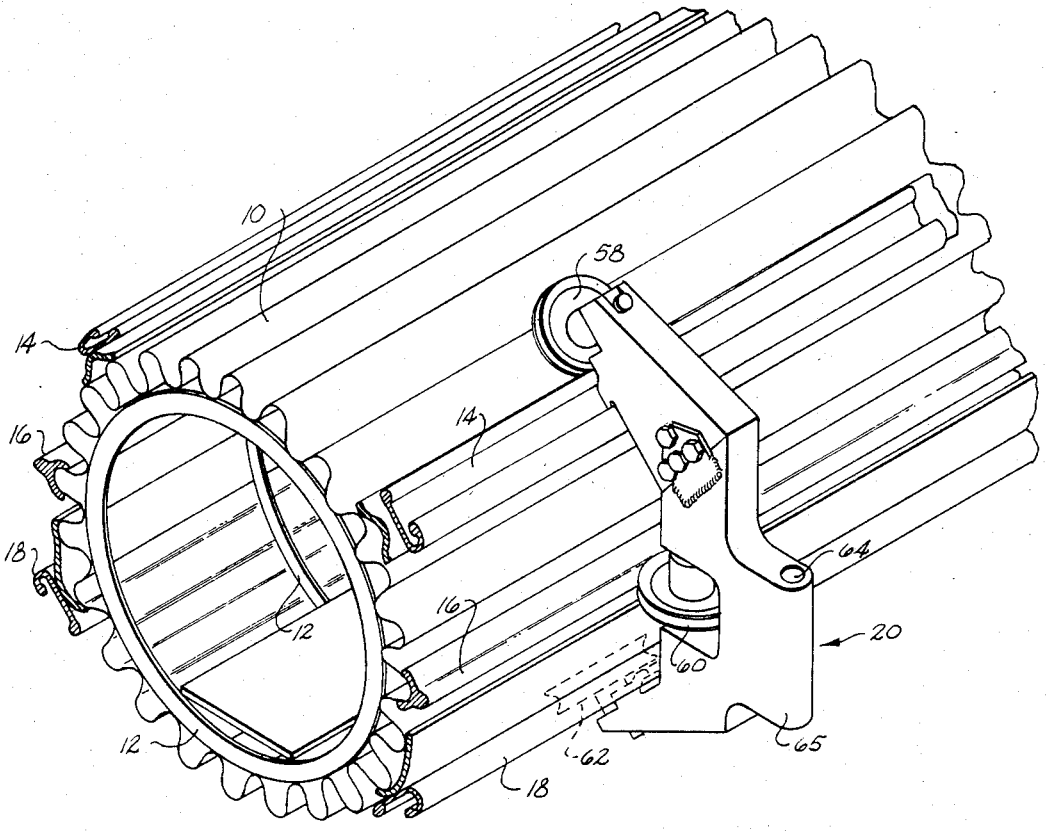
Fig. 2
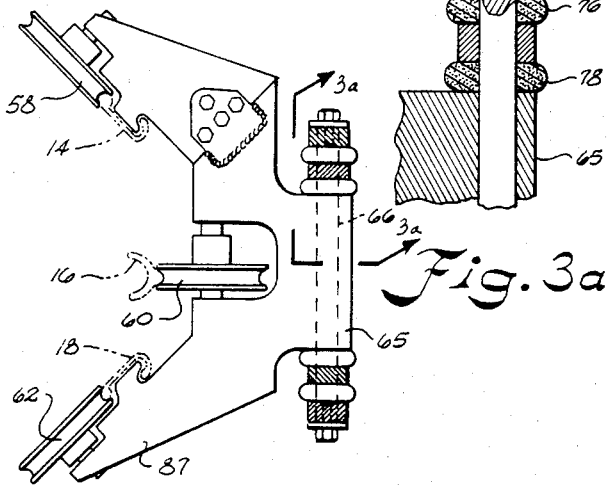
Fig. 3a
Fig. 3
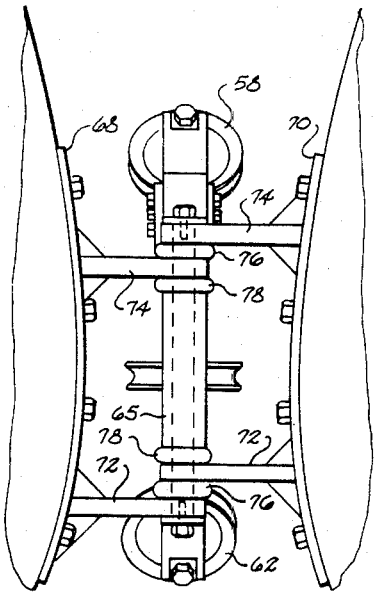
Fig. 4

TRANSPORTATION SYSTEM

BACKGROUND OF THE INVENTION

Heretofore, railway systems for transporting passengers in metropolitan areas and the like have either been built underground in the form of subways or on overhead tracks. Normally, the cars used are provided for transporting many passengers therein. The cars normally have seats positioned on the side as well as along the length of the vehicle. The vehicles also normally have an open space wherein passengers can stand while being transported. As a result, these cars are quite heavy from a standpoint of passenger weight to vehicle weight. Vehicles are powered by means of a locomotive or can be individually propelled through electric tracks and motors provided therein.

Examples of vehicles transported on monorails are shown in U.S. Pat. Nos. 3,890,904 and 3,985,081. In both these devices, the vehicle is secured to the track by means of wheels carried on opposite sides of a rail to provide a more or less interlocking relationship.

In U.S. Pat. No. 3,735,710, there is disclosed a relatively small vehicle that travels between opposed rails that have mounted thereon electrically-operated rotatable drive means that engage a side wall of the vehicle for propelling the vehicle between the rails.

SUMMARY OF THE INVENTION

This invention relates to an apparatus for transporting people and, more particularly, to a transportation system which can be readily used in metropolitan areas for rapidly loading and unloading people from a platform into and from a plurality of vehicles. The system includes a continuous trackway with a plurality of cars carried thereon. Each car is adapted to be loaded through side doors as the cars are stopped at a platform. The cars are, in turn, supported on a three-wheel trolley that rides on a track that can be conveniently located between dual-lane highways or in other locations where there is a limited amount of space. Driving/braking wheels are strategically spaced along the rail for engaging a keel provided on the vehicles for propelling the vehicles along the trackway or for braking the vehicle to a stop.

The vehicles are constructed so that they are relatively small and, as a result, lightweight rail systems can be safely utilized.

Doors carried on the side of the cars are provided with latches and mechanism for being automatically opened upon reaching a platform located within a station.

Accordingly, it is an important object of the present invention to provide a relatively small, lightweight vehicle which permits passengers to be seated sideways in the cars.

Another important object of the present invention is to provide a transportation system which includes a plurality of cars wherein the weight ratio between the passengers to the cars is much greater than the more conventional rapid transit systems wherein the weight ratio between passengers to cars is much less.

Another important object of the present invention is to provide propulsion system for cars of a transit system that utilizes driven wheels and the like strategically spaced along the length of the track for providing a driving and braking mechanism for the vehicles.

Another important object of the present invention is to provide a rapid transit people-moving system which utilizes vehicles wherein the total vehicle is accessible by means of side doors as compared to rapid transit systems that utilize a single door or a limited number of doors.

Another important object of the present invention is to provide a transportation system which has a plurality of fail-safe systems to prevent the vehicles from jumping off the track regardless of whether the support wheels associated with the trolley are damaged or dislodged.

Still another important object of the present invention is to provide a transportation system which provides individual passengers with personal security and isolation.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

BRIEF DESCRIPTION OF THE DRAWINGS

FIG. 2 is an enlarged perpsective view partially in section illustrating a trackway forming part of the rail system.

FIG. 3 is an enlarged side elevational view illustrating a trolley used for securing the vehicle to the trackway.

FIG. 3*a* is a sectional view taken along line 3—3 of FIG. 3.

FIG. 4 is an enlarged elevational view illustrating the manner in which adjacent vehicles are coupled to trolleys and to each other.

DESCRIPTION OF A PREFERRED EMBODIMENT

Figure 1:
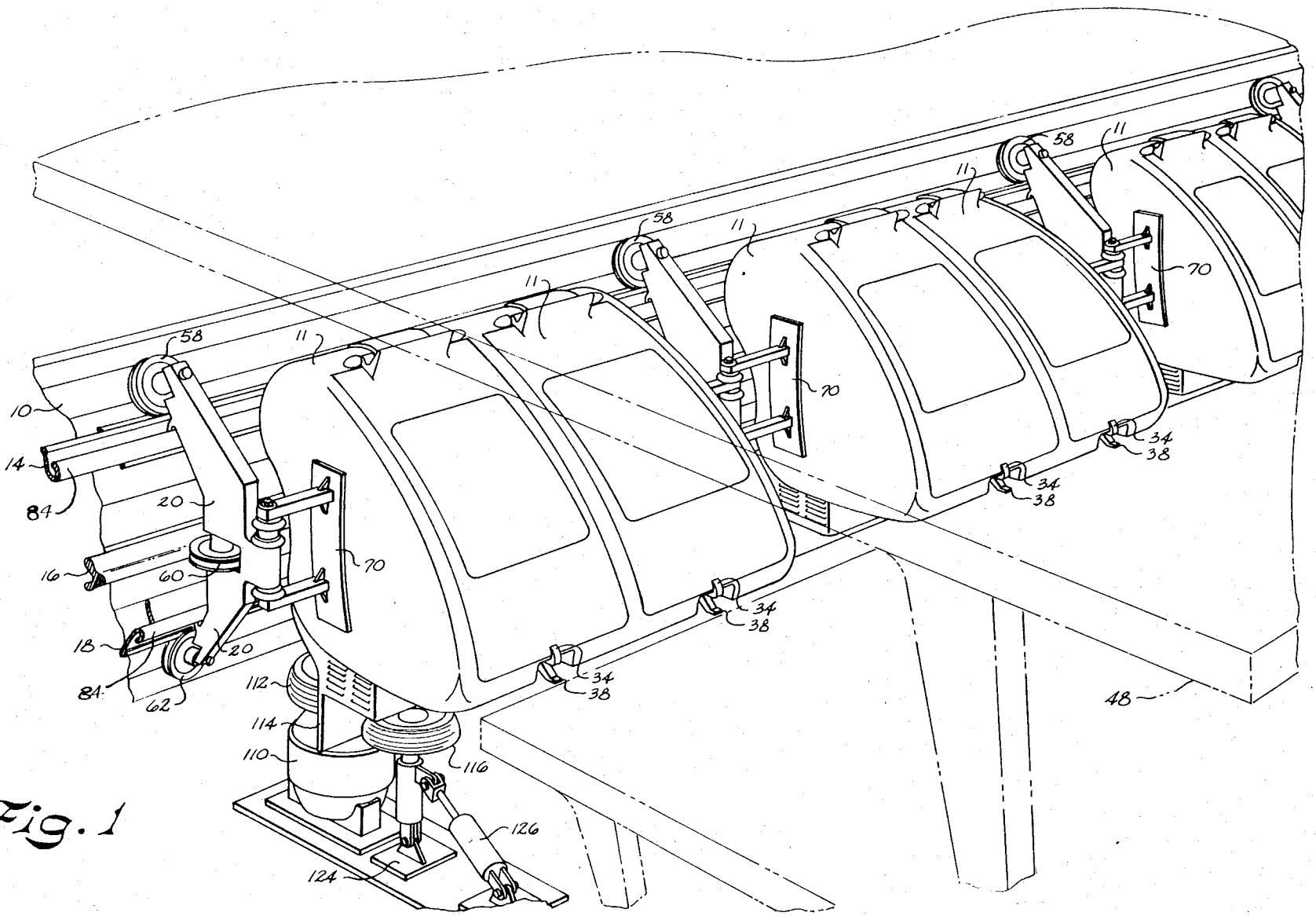
FIG. 1 is a perspective view illustrating the vehicles forming part of a transportation system constructed in accordance with the present invention.

Referring to FIGS. 1 and 2, there is illustrated a transportation system constructed in accordance with the present invention which includes an elongated trackway 10 constructed of any suitable material such as reinforced corrugated steel members. The cylindrical corrugated member can be suitably reinforced by any suitable means such as the longitudinally spaced reinforcing rings 12.

Positioned on opposite sides of the trackway are three rails 14, 16, and 18 upon which trolleys 20 ride.

The trolleys 20 in turn support the cars 11 of the transportation system. The trackway 10 may be supported on any suitable structure and can be located over the median between highways. Of course, it is adapted to be located in any area where there is adequate space for permitting the cars to travel therealong.

As shown in FIGS. 1, 6, 7, 8, 9 and 10, the cars 11 are provided for accommodating passengers on seats that run along the length of the car. Each passenger compartment has a side opening door 24 which permits ready access to the interior of the car when opened.

Figure 8:
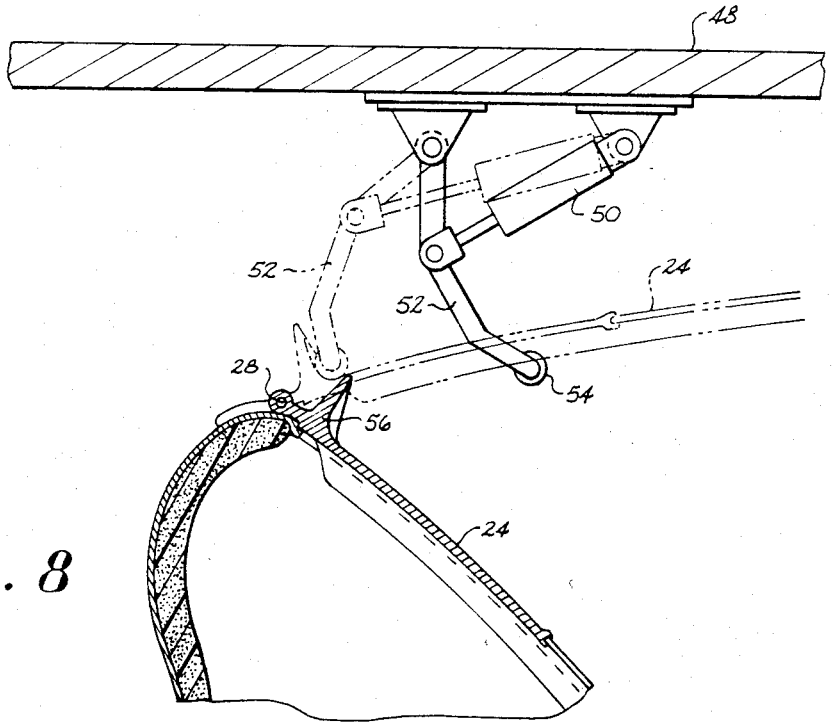
FIG. 8 is a side elevational view illustrating the manner in which the doors of the vehicle are automatically opened upon reaching the platform.
Figure 9:
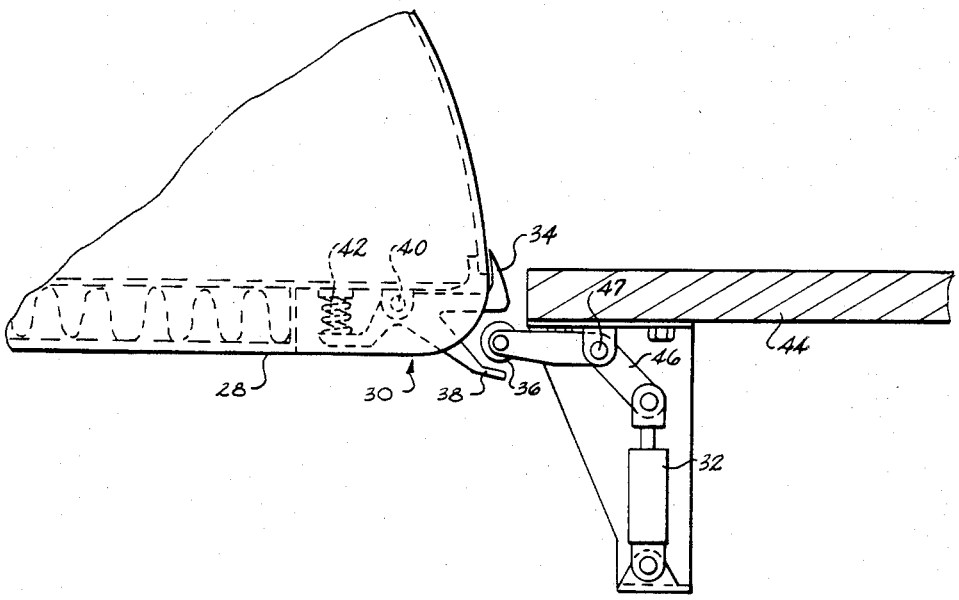
FIG. 9 is a side elevational view illustrated in the manner in which the doors of the vehicle are automatically unlatched upon reaching the platform.
Figure 10:
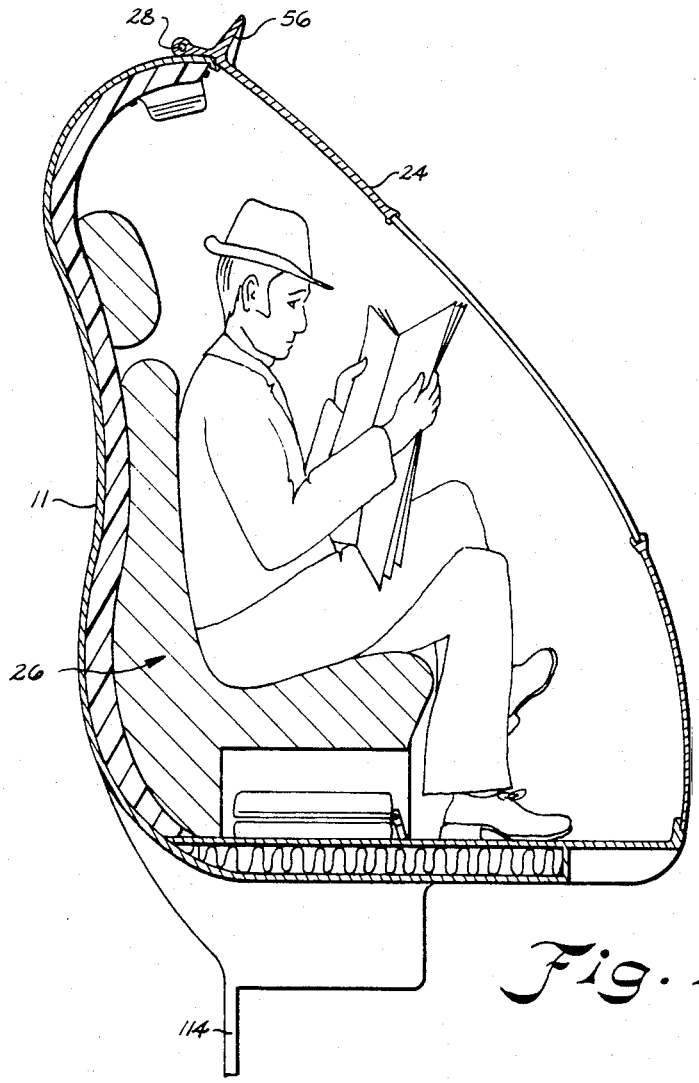
FIG. 10 is a sectional view showing a passenger seated within the vehicle.

While the car can take many different shapes and designs, the preferred embodiment is to provide a seat 26 which runs the length of the car so that a passenger such as shown in FIG. 10 substantially fills up the interior of the car. The side wall of the car includes the door 24 which is hinged about point 28 so that upon entering a platform such as shown in FIGS. 1 and 9, the doors 24 can be automatically unlatched and raised. Positioned adjacent the bottom 28 of the car is a latching mechanism 30 that is triggered by a hydraulic or pneumatically operated cylinder 32. When the cylinder is activated for releasing the latch flange 34 carried adjacent the door, a roller 36 moves downwardly and engages an outwardly extending arm 38 causing the entire latch to pivot downwardly about pivot point 40 against the tensioning spring 42. This permits the door to be opened so that upon activating another cylinder such as shown in FIG. 8, it can be automatically raised. Such will be described in more detail below.

As shown in FIG. 9, the latch-releasing mechanism is bolted to the underside of a platform 44 and includes a dog-leg arm 46 which pivots about a point 47. The tripping roller 36 is carried on the outer end of the dog-leg arm 46, and the inner end of the dog-leg arm is pivotably attached to the outer end of the piston associated with cylinder 32.

The mechanism for automatically raising the door 24 once it has been unlatched is disclosed in FIG. 8. Extending downwardly from an overhead ceiling 48, which extends over the loading platform is a cylinder 50 that, upon being activated, moves an arm 52 outwardly towards the vehicle so that a roller 54 carried on the end thereof engages an upwardly projecting flange 56 carried on the top of the door. As the arm 52 is forced further forward, the door is pivoted about hinge 28 from the full line position shown in FIG. 8 to the phantom line position.

The cylinder 50 may be operated simultaneously with the latching cylinder 32 to ensure that the latch 30 is tripped prior to attempting to raise the door. Any suitable controls can be used for activating the unlatching and door-opening cylinders 32 and 50.

The trolleys 20 extend between the trackway and the vehicles supporting the vehicles on the trackway. Each of the trolleys includes a U-shaped support member which has an upper wheel 58 supported on an upper arm of the housing, an intermediate wheel 60 rotatably supported in a recess provided adjacent the central portion of the housing, and a lower wheel 62 rotatably supported on a lower arm 87 adjacent the bottom of the housing. The upper, lower and intermediate wheels 58, 60 and 62 are inclined so as to provide an interlocking relationship between the rails 14, 16, and 18, respectively. It is noted that the rails 14 and 18 are carried on a tangent of the corrugated track 10 and the upper rail 14 is inclined downwardly with the lower rail being inclined upwardly. As a result of the wheels 58 and 62 being carried at a corresponding angle by the trolleys 20, an interlocking relationship is provided between the rails and the wheels. The intermediate wheel 60 and intermediate rail 16 cooperate with the upper and lower wheels 58 and 62 to hold the trolley in proper position relative to the trackway.

Referring to FIGS. 2–4, there is disclosed the manner in which the adjacent cars are attached to the trolleys. Each of the trolleys 20 has an inward projection 65 which has a vertically extending bore 64 provided therein. The purpose of the bore 64 is to receive a connecting bolt 66 so as to couple brackets 68 and 70 projecting outwardly from the ends of the individual cars together. Each of the brackets 68 and 70 has horizontally extending flanges 72 and 74 which have holes provided in the inner ends thereof. When these holes are in alignment with the cylindrical bore 64 provided in the projection, the coupling bolt 66 is inserted through the arms 74 and 72 for securing the vehicles together. Pneumatic cushions 76 and 78 are interposed between the respective arms 74 and 76 and the projection for absorbing any shocks transmitted through the cars and the coupling trolleys 20 as the vehicles are transported along the track.

Figure 5:
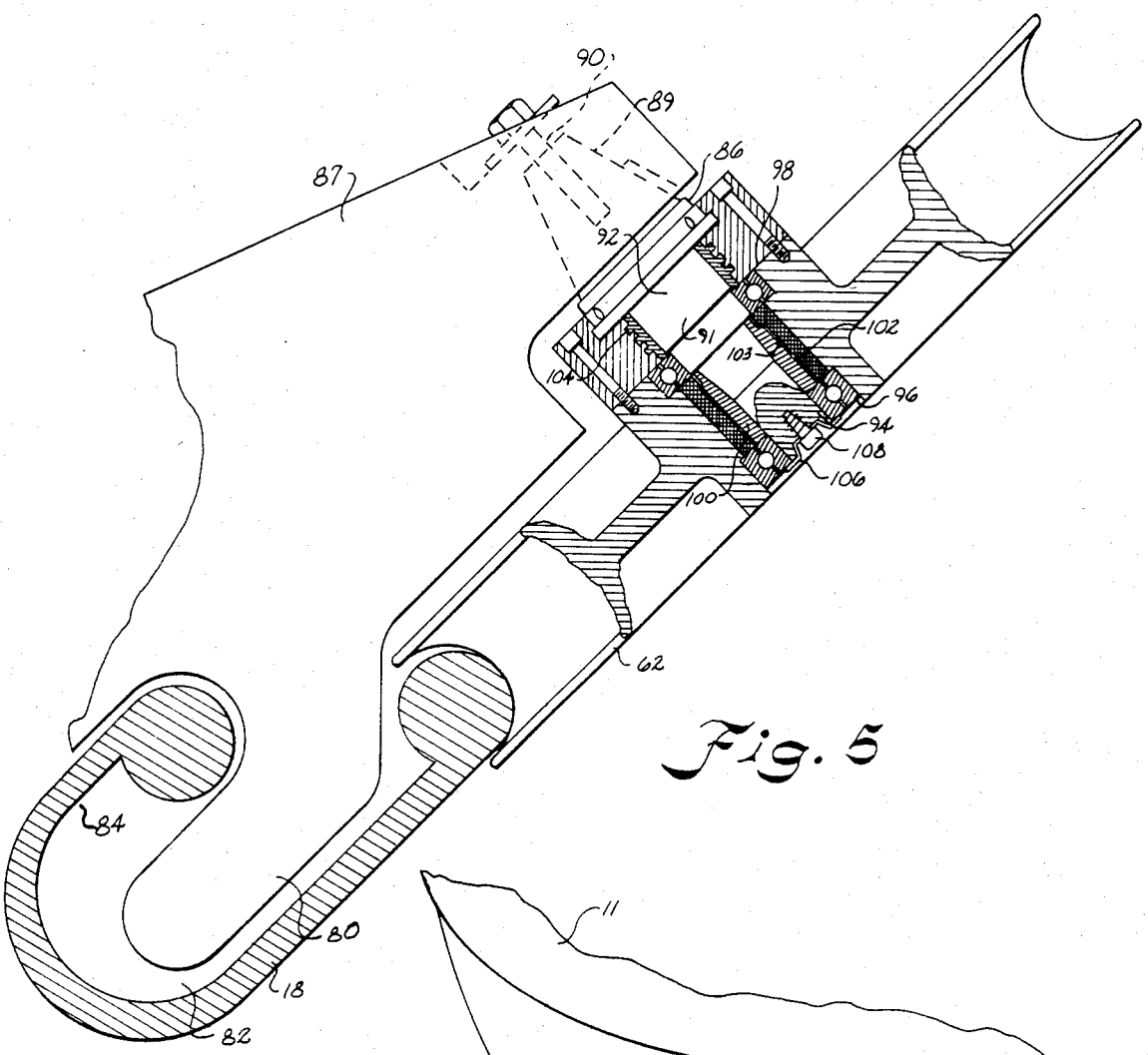
FIG. 5 is an enlarged sectional view illustrating the manner in which the drive rails are constructed and ride on the rails located on the track.
Figure 6:
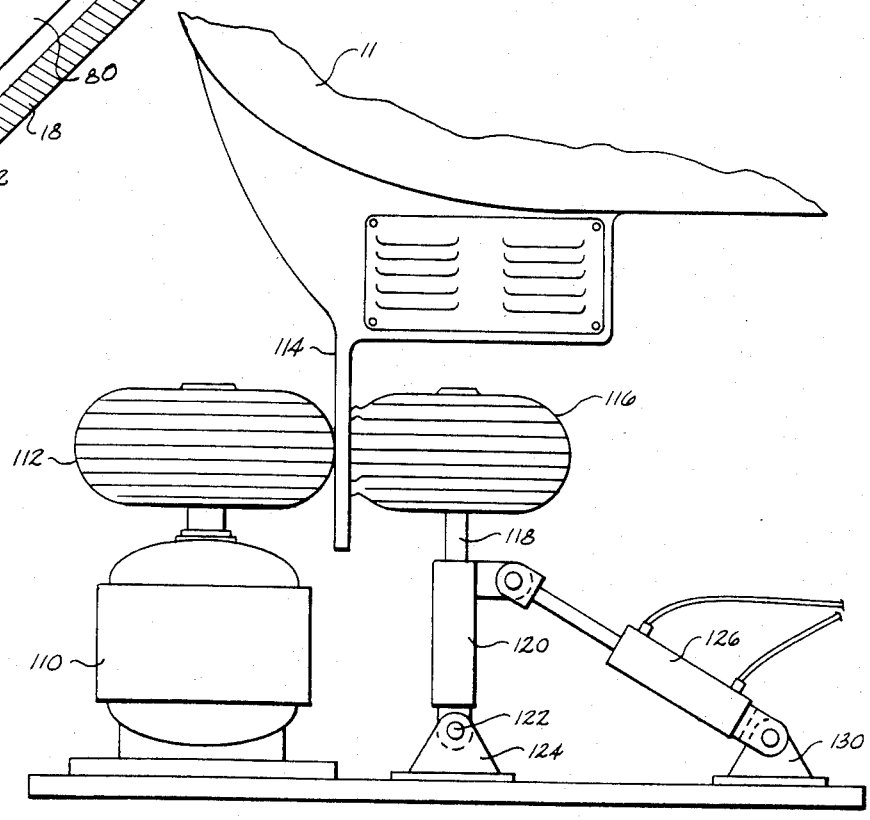
FIG. 6 is an enlarged elevational view illustrating the drive mechanism for the vehicle.

Referring in more detail to FIG. 5, each of the trolleys have a fail-safe flange 80 that rides in a groove 82 defined by a flange 84 spaced from the supporting rail as illustrated in FIG. 5. It is noted that the rounded upper portion of the supporting rail provides the track upon which the wheel 62 rides. If for some reason either of the wheels 58 or 62 collapse or malfunction, the trolley will remain locked on the rails by the fail-safe flange 80 which would then come in contact with the U-shaped portion of the rail extending around the groove 82.

While the fail-safe flange 80 is shown being carried by the trolley 20, it is to be understood that the fail-safe flange could be carried on a rear portion of the car to support the car even if the entire trolley failed.

As illustrated in FIG. 5, the wheels 58, 60 and 62 are suitably supported on bearings carried on a spindle 91. The spindle 91 has a frusto-conical shaped portion 89 which is imbedded within the trolley frame 87 and secured therein by any suitable means such as a bolt and nut 90. An enlarged diameter end 86 of the spindle 91 is integral with a reduced diameter portion 92 which tapers downwardly to its outermost extremity as shown by reference character 94. Positioned on the spindle 91 are a pair of spaced bearings 96 and 98. Interposed between the spaced bearings 96 and 98 is a cylindrical sleeve 100 which extends around the spindle. Concentrically mounted adjacent the sleeve 100 is a self-lubricating bushing 102. The purpose of the bushing 102 is to provide a fail-safe system for the bearings 96 and 98. As can be seen, when the bearings are in proper condition, there is a clearance 103 provided between the bushing 102 and the sleeve 100. However, if either of the bearings 98 or 96 fail, the bushing 102 will then ride on the sleeve 100 until proper servicing can take place. Seals 104 of any suitable type are provided adjacent the inner end of the bearing 98 and the enlarged flange portion 86 of the spindle. A retaining plate 106 is secured to the end of the spindle by any suitable means such as a screw 108 for holding the inner race of the bearing 96 in position. Lubricating passages are normally provided through the bearing for lubricating the various components thereof, however, such are not illustrated since any suitable conventional lubricating system could be utilized.

The cars 11 of the transportation system are propelled along the trackway by a plurality of spaced driving/braking variable speed motor/generators 110. Positioned on the shaft of the motor generator 110 is a pneumatic wheel 112 which engages a vertically extending keel 114 carried on the bottom of the cars 11. Positioned on the opposite side of the keel 114 from the pneumatic wheel 112 is another pneumatic wheel 116 that is carried on a rotatably mounted shaft 118. The shaft 118 is in turn rotatably supported within a cylinder 120 that is pivotably supported adjacent its bottom on a pin 122 carried in a bracket 124. A pneumatic or hydraulic cylinder 126 is pivotally connected between the cylinder 120 and a bracket 130. The cylinder 126 is a double acting cylinder so that the wheel 116 can be selectively brought in contact and away from the keel 114 of the cars. The wheel 116, when the cylinder 126 is activated, presses against one side of the keel 114 causing the keel to be pressed against the driving/braking wheel 112.

When it is desired to propel the cars 11 along the trackway, the driving/braking motor/generators 110 are energized rotating the wheels 112 causing the cars to be propelled along the trackway. As the vehicles come into a station, the driving/braking motor 110 acts as a generator so that upon the keels engaging the wheels 112, a braking action is applied to the cars through the keels for stopping the vehicle.

Figure 7:
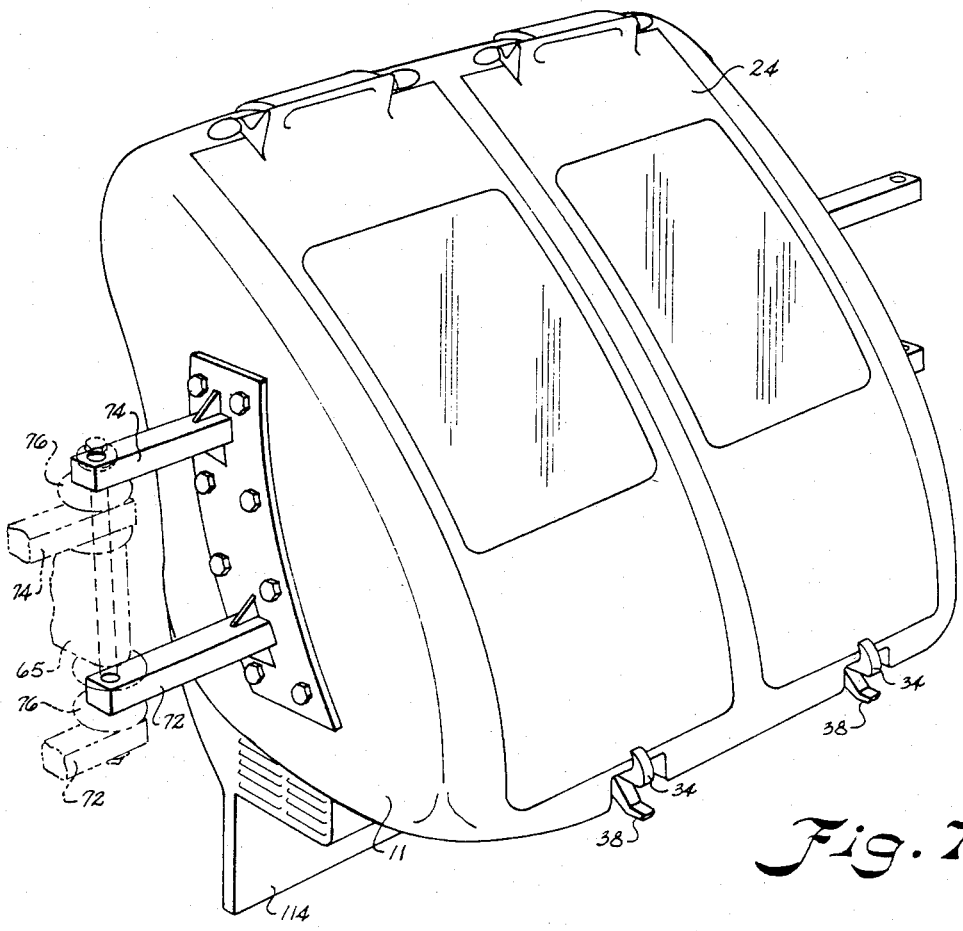
FIG. 7 is a large perspective view of one of the vehicles forming part of the rail system.

While the cars 11, as shown in FIGS. 1 and 7, include two side doors for providing access to the vehicles, it is to be understood any number of doors could be used or, of course, a single door 24 can be utilized and each car can be provided for accommodating a single passenger or several passengers.

While a preferred embodiment of the invention has been described using specific terms, such description is for illustrative purposes only, and it is to be understood that changes and variations may be made without departing from the spirit or scope of the following claims.

What is claimed is:

1. A transportation system for rapidly loading people from a platform into and from a plurality of vehicles comprising:

an elongated vehicle trackway extending along said people loading platform;

trolleys extending between said vehicle trackway and said vehicles supporting said vehicles on said trackway;

side entrance openings formed in said vehicle facing said loading platform, a lowermost portion of said side entrance openings being generally level with said loading platform;

side doors carried on and extending along the length of said vehicles for closing said side entrance opening, said side doors being generally parallel to said vehicle trackway facing and opening towards said loading platform;

hinges carried adjacent a top portion of said side doors securing said doors to said vehicles permitting said doors to be opened from the bottom providing access to said cars;

a single row of seats carried in said vehicles facing said doors and said loading platform;

latch means carried adjacent the bottom of said doors holding said doors closed;

means carried by said loading platform for disengaging said latch means as said cars are positioned along the side of said platform and for releasing said latch means; and means for raising said doors after release of said latch including power driven door actuators carried adjacent said loading platform external to said vehicles that remain fixed with respect to motion of said vehicle, and door flanges carried on a portion of said doors for engagement by said door actuators, whereby said doors are raised vertically upon engagement and actuation of said actuators on said door flanges.

2. The transportation system as set forth in claim 1 further comprising:

said trackway including:

(i) an upper rail inclined upwardly away from said vehicles, (ii) a lower rail inclined downwardly away from said vehicles, and (iii) an intermediate substantially horizontal rail positioned between said upper and lower rail, each of said trolleys including:

(i) an upper wheel riding on said upper rail, (ii) a lower wheel riding on said lower rail, and (iii) an intermediate wheel riding on said intermediate rail, and said upper, lower and intermediate wheels providing an interlocking relation between said rails carried on said trackway and said trolleys.

3. The transportation system as set forth in claim 2 further comprising:

coupling members carried adjacent the ends of said vehicles connecting said vehicles to said trolleys.

4. The transportation system as set forth in claim 2 further comprising:

said trackway including an elongated corrugated support; and said upper, lower and intermediate rails being carried on said elongated corrugated support.

5. The transportation system as set forth in claim 2 further comprising:

flanges carried by said upper and lower rails defining upper and lower grooves on said rails;

a fail-safe flange carried adjacent said upper wheel extending into said upper groove;

a fail-safe flange carried adjacent said lower wheel extending into said lower groove;

said fail-safe flanges riding in said respective grooves under normal conditions out of contact with said wheels and resting on said rails upon failure of said trolley wheels.

6. The transportation system as set forth in claim 1 further comprising:

a vertically extending keel carried by at least some of said vehicles;

a plurality of power driven wheels spaced along said elongated trackway for engaging said keel for propelling said vehicle along said trackway.

7. The transportation system as set forth in claim 6 further comprising:

said power driven wheels being positioned on one side of said trackway, and an adjustable pressure bearing wheel carried on the opposed side of said keel from said power driven wheels for maintaining said keel in driving contact with said power driven wheel.

8. The transportation system as set forth in claim 7 further comprising:

means for journaling said pressure bearing wheel for rotation, and a power-operated cylinder for selectively forcing said pressure bearing wheel against said keel.

9. The transportion system as set forth in claim 7 further comprising:

said power driven wheel being connected to a variable speed motor/generator for selectively propelling said vehicle on said trackway and braking said vehicle.

10. A transportation system for rapidly loading people from a platform into and from a plurality of vehicles comprising:

an elongated trackway extending along said platform;

trolleys extending between said trackway and said vehicles supporting said vehicles on said trackway;

said trackway including, (i) an upper rail inclined upwardly away from said vehicles, (ii) a lower rail inclined downwardly away from said vehicles, and (iii) an intermediate substantially horizontal rail positioned between said upper and lower rail, each of said trolleys including, (i) an upper wheel riding on said upper rail, (ii) a lower wheel riding on said lower rail, and (iii) an intermediate wheel riding on said intermediate rail, and said upper, lower and intermediate wheels providing an interlocking relation between said rails carried on said trackway and said trolleys;

said trackway comprising an elongated corrugated tubular support, said tubular support having a corrugated surface, said surface having a plurality of longitudinal grooves alternating with longitudinal radially extending fluted elements having hollow interiors, said upper, lower, and intermediate rails being carried on circumferentially spaced ones of said fluted elements providing support for a pair of vehicles facilitating two-way vehicular traffic from a single vehicle support.

11. The transportation system as set forth in claim 10 further comprising:

coupling members carried adjacent the ends of said vehicles connecting said vehicles to said trolleys.

12. The transportation system as set forth in claim 10 further comprising:

a vertically extending keel carried by at least some of said vehicles;

a plurality of power driven wheels spaced along said elongated trackway for engaging said keel for propelling said vehicle along said trackway.

13. The transportation system as set forth in claim 12 further comprising:

said power driven wheels being positioned on one side of said trackway, and an adjustable pressure bearing wheel carried on the opposed side of said keel from said power driven wheels for maintaining said keel in driving contact with said power driven wheel.

14. The transportation system as set forth in claim 12 further comprising:

a variable speed motor/generator connected to said power driven wheels for selectively providing a propelling force and braking force to said vehicles.

15. A transportation system for rapidly loading people from a platform into and from a plurality of vehicles comprising;

an elongated vehicle trackway extending along said platform, including longitudinaly extending rail means, flanges carried by said rail means defining grooves on said rail means;

trolleys extending between said vehicle trackway and said vehicles supporting said vehicles on said trackway, including bearing means for allowing motion of said trolleys on said rail means, fail-safe flanges carried by said trolleys ajacent said flanges carried by said rail means;

said fail-safe flanges riding without contact in said grooves on said rail means under normal conditions and resting upon said rail means upon failure of said trolley bearing means;

side entrance openings formed in said vehicle facing said loading platform, a lowermost portion of said side entrance openings being generally level with said loading platform;

side doors carried on and extending along the length of said vehicles for closing said side entrance opening, said side doors being generally parallel to said vehicle trackway facing and opening towards said loading platform;

hinges carried adjacent a top portion of said side doors securing said doors to said vehicles permitting said doors to be opened from the bottom providing access to said cars;

a single row of seats carried in said vehicles facing said doors and said loading platform;

latch means carried adjacent the bottom of said doors holding said doors closed; and means carried by said loading platform for disengaging said latch means as said cars are positioned along the side of said platform and for releasing said latch means permitting a plurality of cars to be simultaneously loaded and unloaded through said doors.

* * * * *